US006905045B2

(12) United States Patent
Yu Chen

(10) Patent No.: US 6,905,045 B2
(45) Date of Patent: Jun. 14, 2005

(54) THIN FILM BAG DISPENSER

(76) Inventor: Hsiu-Man Yu Chen, No. 27, Sec. 1, Ta Fu Road, Tan Tzu Hsiang, Taichung (TW), 427

( * ) Notice: Subject to any disclaimer, the term of this patent is extended or adjusted under 35 U.S.C. 154(b) by 191 days.

(21) Appl. No.: 10/453,639

(22) Filed: Jun. 4, 2003

(65) Prior Publication Data

US 2004/0245282 A1 Dec. 9, 2004

(51) Int. Cl.[7] ..... B65H 1/00

(52) U.S. Cl. ..... 221/33; 242/588

(58) Field of Search ..... 221/33; 242/588, 242/423.1

(56) References Cited

U.S. PATENT DOCUMENTS 4,166,589 A * 9/1979 Hoover et al. ..... 242/423.1

* cited by examiner

*Primary Examiner*—Kenneth Noland
(74) *Attorney, Agent, or Firm*—Troxell Law Office PLLC

(57) ABSTRACT

A thin film in bag dispenser includes a holding cylinder and a rotatable ring fitting rotatably around a rear outer surface of the holding cylinder. The cylinder body of the holding cylinder is provided with a plurality of lengthwise blocking ribs and lateral one-way blocks spaced apart on an outer surface, and an annular fitting aperture is formed on the outer surface between the open ends of the blocking ribs and the one-way bocks for the rotatable ring to fit around the annular fitting aperture. Then the rotatable ring can be rotated manually and freely relative to the holding cylinder.

3 Claims, 5 Drawing Sheets

THIN FILM BAG DISPENSER

BACKGROUND OF THE INVENTION

1. Field of the Invention

This invention relates to a thin film bag dispenser, particularly to one having a simple structure for easily handling and made of low cost, 2. Description of the Prior Art A roll of cylindrical film bags is positioned rotatably on a hollow shaft for wrapping things, with a separate bag looking like a PE film in daily use, and used for wrapping a substantially large things, for protecting them from water and dirt and also keeping them stably. A conventional cylindrical film bag is to be wrapped around an object by holding the two ends of a shaft tube with a roll of the cylindrical film bags and pulling out cylindrical film bags out of the roll and then is made to wrapped around objects. But this kind of handling is not convenient, as objects are mostly of a large size and rather heavy. A conventional cylindrical film bag dispenser shown in FIG. 1 includes a holding cylinder 11, and a rotatable cylinder 12 combined together. The holding cylinder 11 has a cylindrical shaft body 111 provided with one end surface formed with a grip hole (not shown) and the rotatable cylinder 12 fits rotatably around the, shaft body 111 of the holding cylinder 11, having a plurality of ribs 121 spaced apart equidistantly around an outer surface. Then the rotatable cylinder 12 can fit in each of two end holes of a shaft tube for mounting a roll of cylindrical film bags (not shown) so that a separate cylindrical film bag may be pulled out by rotating the roll relative to the two rotatable cylinders 12, with two hands of a user gripping the grip holes of the two holding cylinders 11.

However, the conventional cylindrical film bag dispenser just described has a structure rather complicated, using comparatively much material, and accordingly resulting in high cost.

SUMMARY OF THE INVENTION

The purpose of the invention is to offer a thin film bag dispenser having a simple structure that includes a holding cylinder provided with an outer surface formed with an annular matching aperture for a small-sized rotatable ring to fit with so as to be freely rotate manually, enabling the thin film bag dispenser conveniently handled and made with a lower cost.

BRIEF DESCRIPTION OF DRAWWINGS

This invention will be better understood by referring to the accompanying drawings, wherein.

DETAILED DESCRIPTION OF THE PREFERRED EMBODIMENT

Figure 1:
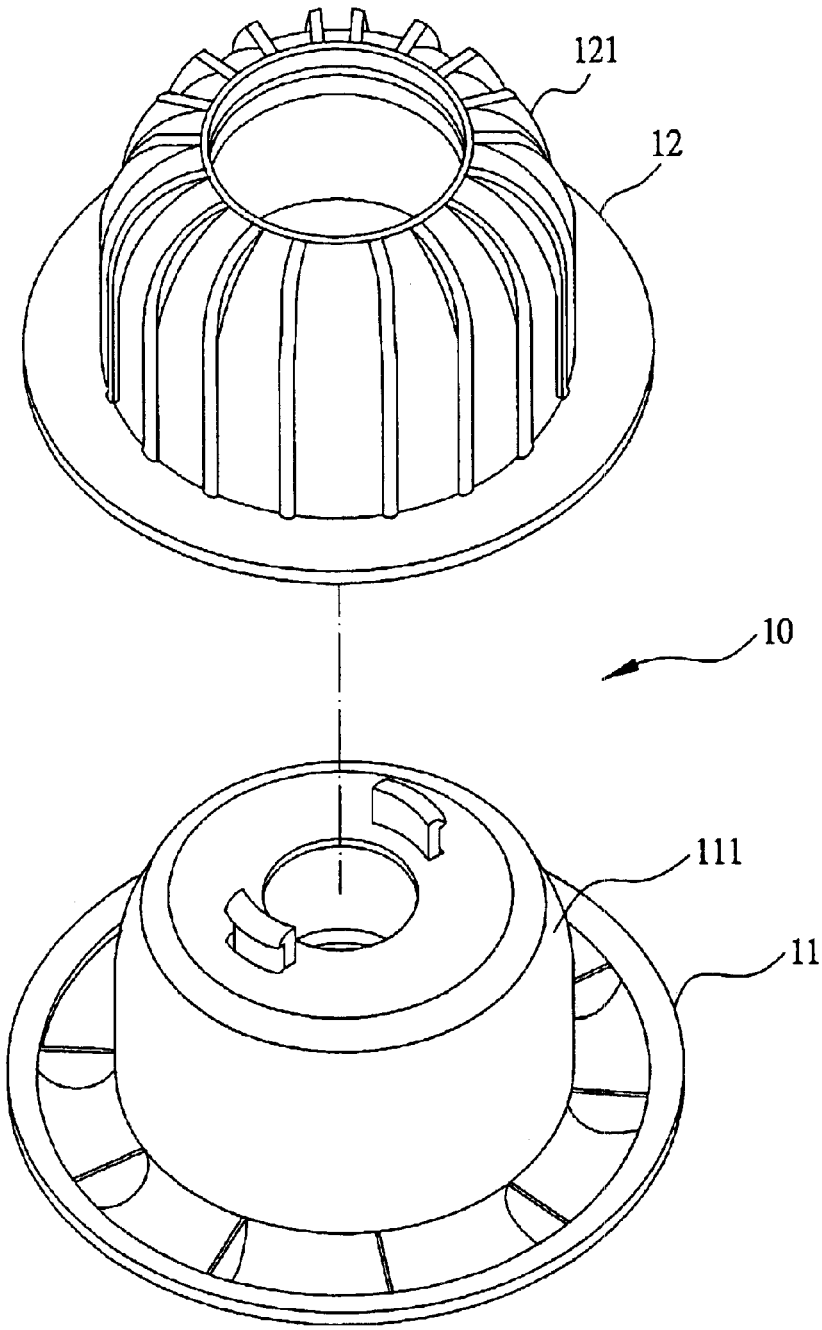
FIG. 1 PRIOR ART
FIG. 1 is an exploded perspective view of a conventional thin film bag dispenser.
Figure 2:
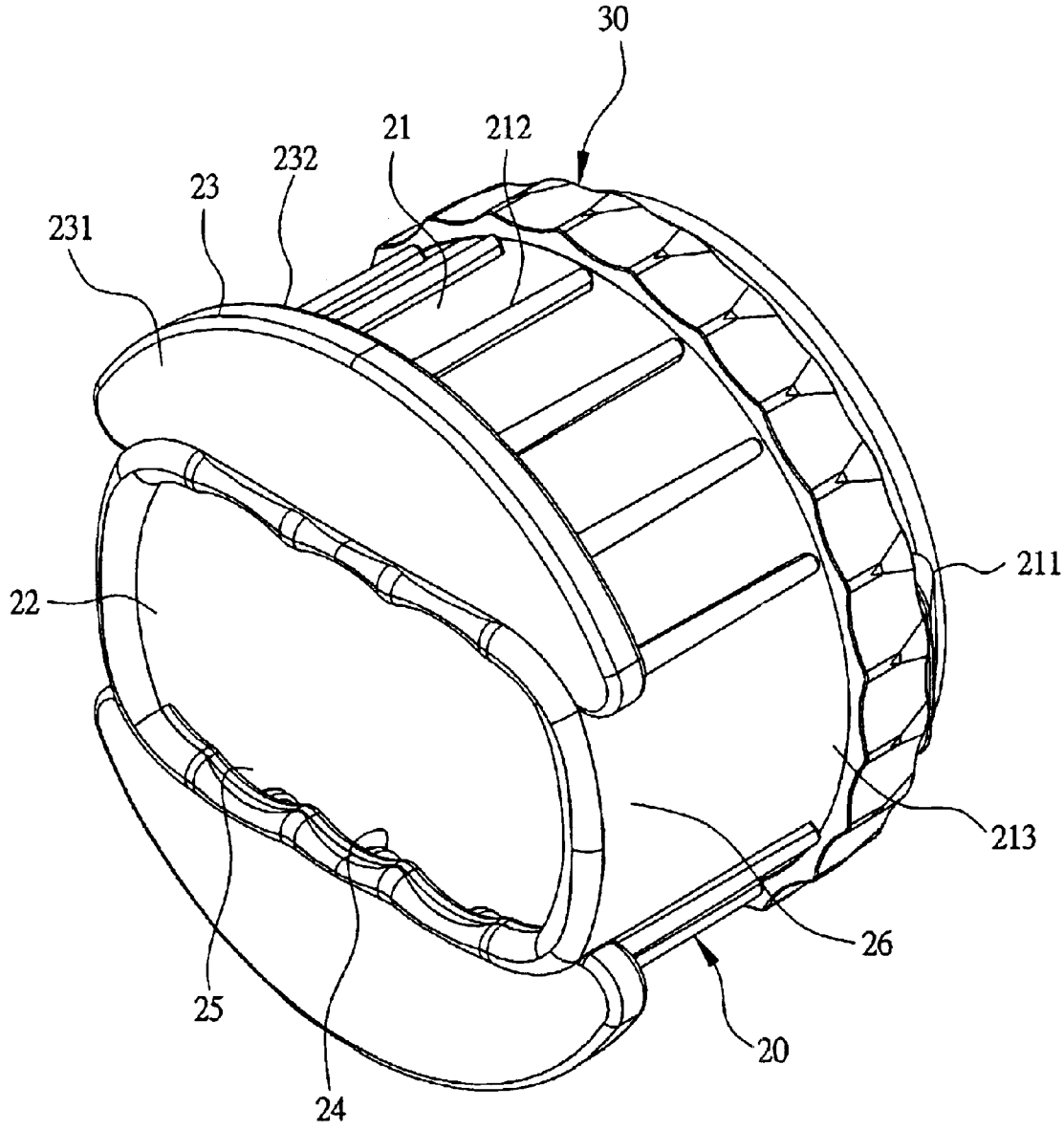
FIG. 2 is a perspective view of a thin film bag dispenser in the present invention.
Figure 3:
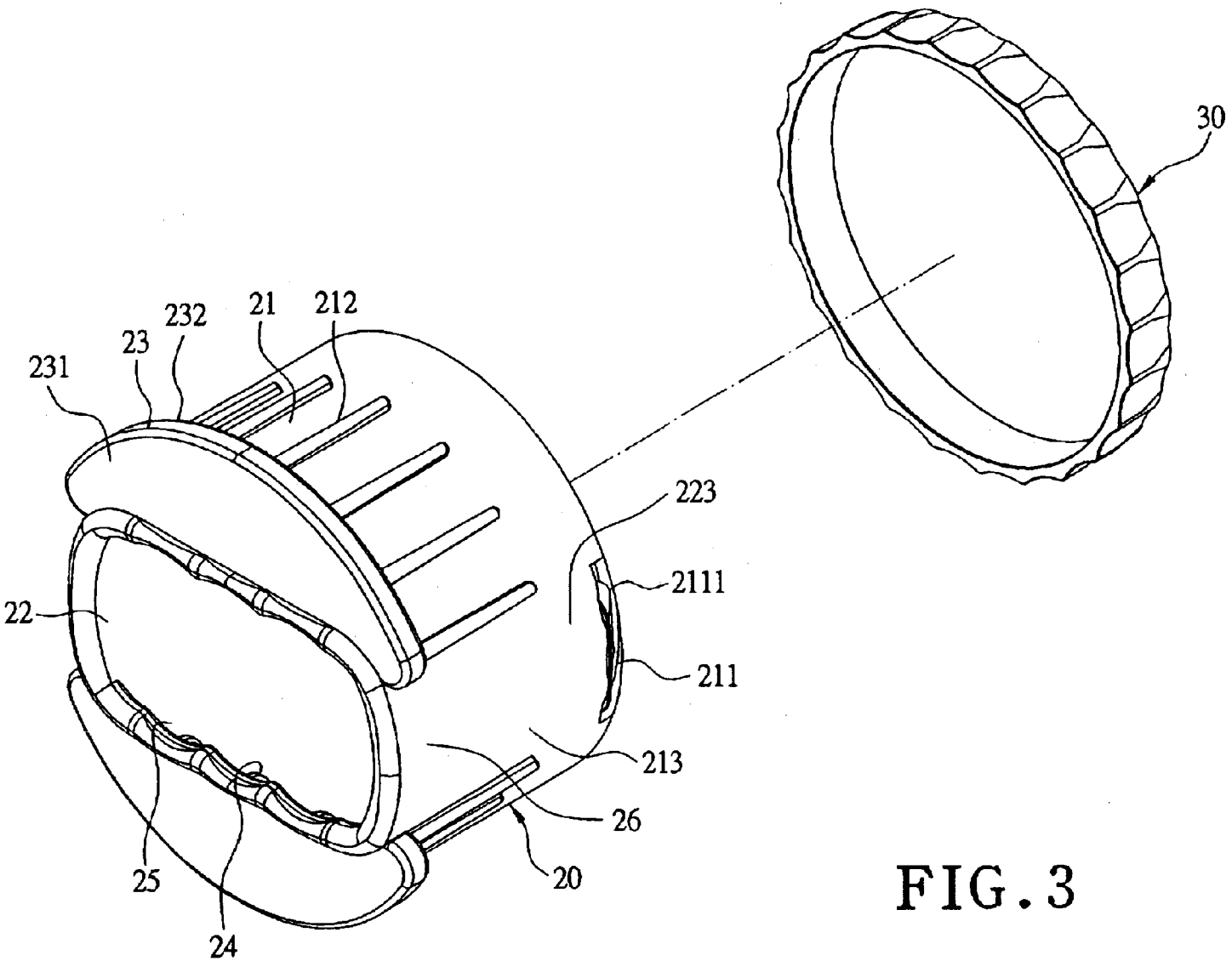
FIG. 3 is an exploded perspective view of the thin film bag dispenser in the present invention.

A preferred embodiment of a thin film bag dispenser in the present invention, as shown in FIGS. 2 and 3, includes a holding cylinder 20, and a rotatable ring 30 as main components combined together.

The holding cylinder 20 has a cylinder body 21 and a grip hole 22 formed in an outer end surface, and the cylinder body 21 is provided with a preset number of lateral one-way blocks 211 sloping outward. Each one-way block 211 has a blocking surface 2111 formed a little higher than the outer surface of the holding cylinder 20, and in this embodiment there are two one-way blocks 211 symmetrically formed. The cylindrical body 21 has a plurality of blocking ribs 212 formed axially spaced apart equidistantly on an outer surface and extending lengthwise from a left side to the intermediate portion and not reaching a right side so a curved matching surface 213 is defined between the left side of the holding cylinder 20 and each of the two one-way blocks 211, and an annular fitting surface 223 is defined between the one-way blocks 211 and the line of the open ends of the blocking ribs 212.

The rotatable ring 30 fits rotatably freely around the annular fitting surface 223 of the holding cylinder 20.

Figure 4:
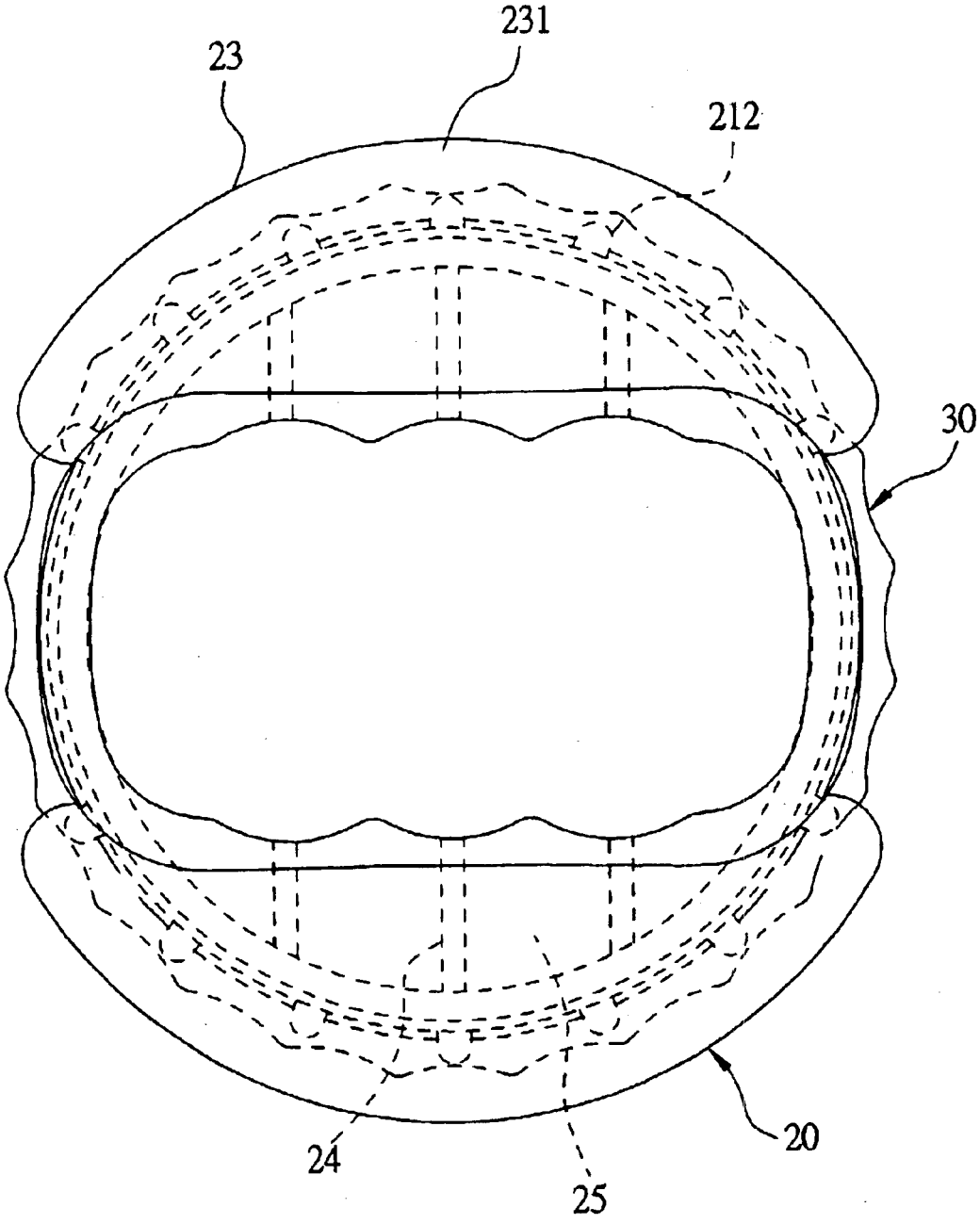
FIG. 4 is a front view of a side of the thin film bag dispenser in the present invention; and, FIG. 5 is a perspective view of the thin film bag dispenser in the present invention, showing it being used for wrapping an object.
Figure 5:
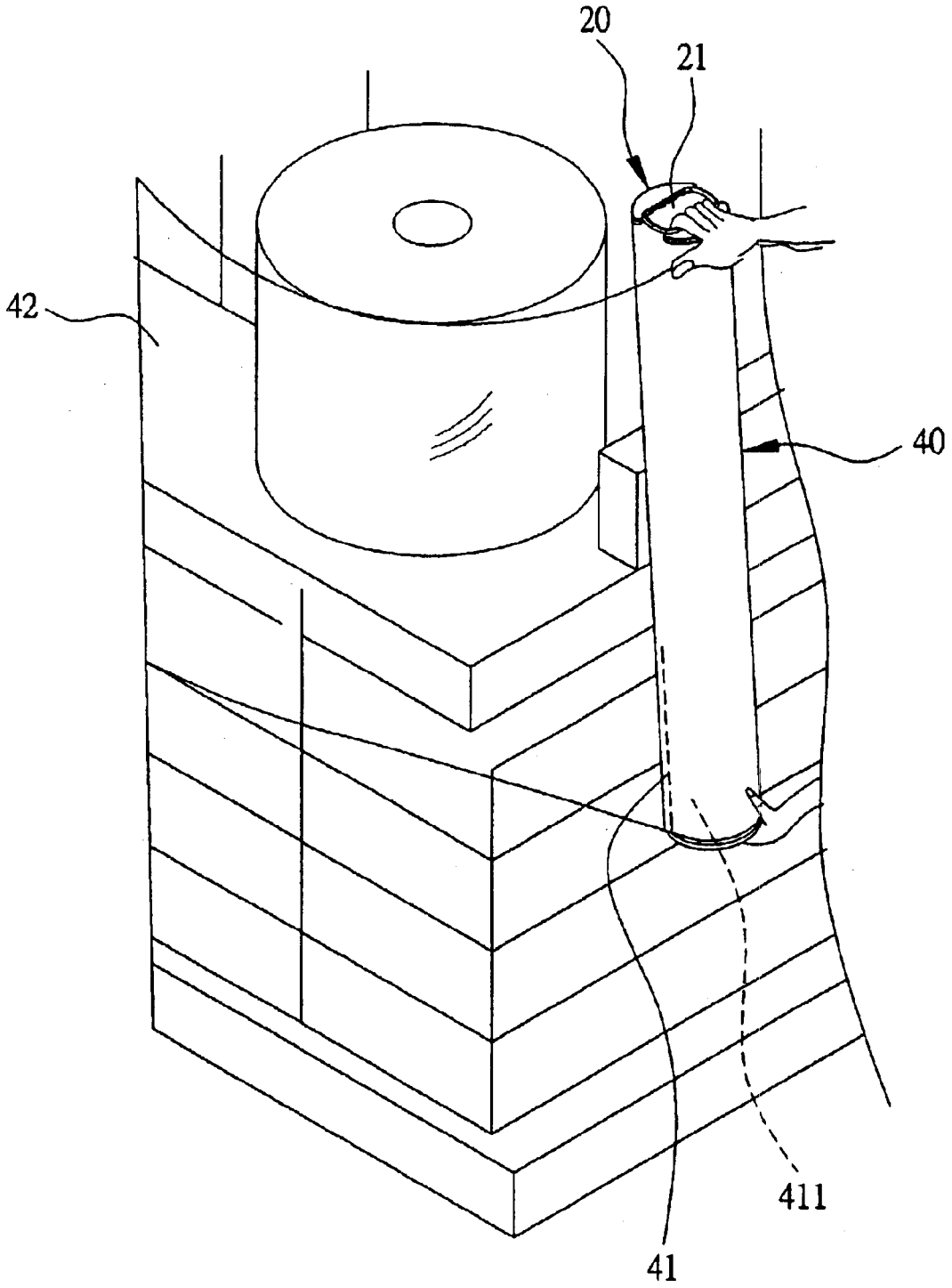

Next, referring FIGS. 4 and 5, the holding cylinder 20 has a vertical sidewall 231 formed at an outer end and having an upper curved side 232 a little higher than the annular outer surface of the holding cylinder 20 and extending inward to function as a hand-resting member 23 for a hand of a user to rest thereon. The vertical sidewall 231 has a center hole 22 nearly rectangular shaped for fingers to extend therein, and a plurality of vertical reinforcing ribs 24 spaced apart on an inner surface. The vertical reinforcing ribs 24 define plural grooves 25 for fingers to extend to hold the cylinder 20 stably so as to prevent the film bag dispenser from slipping off.

Further, it is necessary to note that an aperture 26 is formed in two opposite sides of the vertical side wall 231, respectively facing to the one-way blocks 211 so that a mold for shaping may be pulled off from the apertures 26, not interfering with the hand of a user to reach in the grooves 25.

Next, how to use the thin film bag dispenser is to be described. As shown in FIG. 5, the thin film bag dispenser is to be combined with the shaft tube 41 supporting a roll of cylindrical film bags 40 by the rotatable ring 30 inserted in the two end holes 411 of the shaft tube 41 to keep the thin film bag dispenser with the shaft tube 41 stably. Then a user grips the grip hole 21 with two hands resting on the hand-resting members 23 for ensuring stability of force exerting, in wrapping operation. As the rotatable ring 30 can rotate relative to the holding cylinder 20, the cylindrical film bags 40 can be pulled to move out of the roll rotated with the holding cylinder 20.

The invention has the following advantages, as seen from the foresaid description 1. Compared with the conventional film bag dispenser consisting of the holding cylinder combined with the rotatable cylinder, the invention has the rotatable ring in conjunction with the holding cylinder, simplifying the structure in a large extent and reducing its cost accordingly.
2. The rotatable ring in the invention has a smaller dimension than the rotatable cylinder in the conventional, saving much material needed,
3. The grip hole is provided with the reinforcing ribs to reinforce the structure, and the grooves defined by the reinforcing ribs enable a user to hold the holding cylinder in handling to wrap a thin film bag on an object, elevating stability in operation in addition to no slipping of the hands off the holding cylinder.

While the preferred embodiment of the invention has been described above, it will be recognized and understood that various modifications may be made therein and the appended claims are intended to cover all such modifications that may fall within the spirit and scope of the invention.

What is claimed is:

1. A thin film bag dispenser comprising a holding cylinder provided with a grip hole in an outer end surface, and characterized by:

said holding cylinder having a cylinder body, a plurality of blocking ribs formed axially spaced apart on an outer surface and extending from a left side to an intermediate portion and not reaching to a right side, a preset number of lateral one-way blocks provided spaced apart near a right side and protruding up on the outer space, an annular fitting aperture defined on the outer surface by open ends of said blocking ribs and said one-way blocks; a rotatable ring fitting around on said fitting aperture on the outer surface of said holding cylinder from said one-way blocks, said rotatable ring possible to freely rotate manually relative to said holding cylinder.

2. The thin film bag dispenser as claimed in claim 1, wherein a vertical outer end wall is formed integral with said holding cylinder, said vertical end wall formed with a center grip hole, and an annular edge formed on an outer circumference of said vertical end wall and extending inward, said vertical end wall and said annular edge forming a hand-resting member.

3. The thin film bag dispenser as claimed in claim 1, wherein said vertical outer end wall has plural vertical reinforcing ribs spaced apart on an inner surface, and said vertical reinforcing ribs define plural grooves for fingers of a user to fit therein and hold said holding cylinder stably.

* * * * *